US007526241B2

(12) United States Patent
Kinoshita

(10) Patent No.: US 7,526,241 B2
(45) Date of Patent: Apr. 28, 2009

(54) METHOD AND APPARATUS FOR IMAGE FORMING CAPABLE OF EFFECTIVELY CORRECTING A MISREGISTRATION OF AN IMAGE

(75) Inventor: Izumi Kinoshita, Tokyo (JP)

(73) Assignee: Ricoh Company Ltd., Tokyo (JP)

( * ) Notice: Subject to any disclaimer, the term of this patent is extended or adjusted under 35 U.S.C. 154(b) by 328 days.

(21) Appl. No.: 11/513,176

(22) Filed: Aug. 31, 2006

(65) Prior Publication Data

US 2007/0048031 A1 Mar. 1, 2007

(30) Foreign Application Priority Data

Aug. 31, 2005 (JP) ..... 2005-251764

(51) Int. Cl.
*G03G 15/00* (2006.01)
*G03G 15/01* (2006.01)

(52) U.S. Cl. ..... 399/301; 347/116; 399/49

(58) Field of Classification Search ..... 399/301, 399/49; 347/116
See application file for complete search history.

(56) References Cited

U.S. PATENT DOCUMENTS 7,366,444 B2 * 4/2008 Takane ..... 399/301
7,373,097 B2 * 5/2008 Ehara ..... 399/301
2007/0292171 A1 * 12/2007 Maeda et al. ..... 399/301

FOREIGN PATENT DOCUMENTS

| | | |
|---|---|---|
| JP | 09-185213 | 7/1997 |
| JP | 2002-131997 | 5/2002 |
| JP | 2003-098793 | 4/2003 |

* cited by examiner

*Primary Examiner*—Susan S Lee
(74) *Attorney, Agent, or Firm*—Harness, Dickey & Pierce, P.L.C.

(57) ABSTRACT

An image forming apparatus forming a color image with color toners includes a plurality of image forming members, an image transfer member, a plurality of sensors, a calculator, an edge extractor, a counter, and a misregistration corrector. The plurality of image forming members forms a plurality of test patches. The image transfer member receives the test patches. The plurality of sensors detects the test patches. The calculator performs a logical operation, e.g., an exclusive-OR operation, upon detection signals output by the sensors. The edge extractor detects edges and generates edge signals based upon an output signal of the calculator. The counter counts clock pulses with respect to the edge signals to determine a length of each of the test patches. The misregistration corrector calculates time lags among the detection signals based on count values counted by the counter for the test patches and correct misregistration of the color image based on the calculated time lags.

20 Claims, 17 Drawing Sheets

METHOD AND APPARATUS FOR IMAGE FORMING CAPABLE OF EFFECTIVELY CORRECTING A MISREGISTRATION OF AN IMAGE

PRIORITY STATEMENT

This patent specification is based on Japanese patent application, No. JP2005-251764 filed on Aug. 31, 2005 in the Japan Patent Office, the entire contents of which are hereby incorporated herein by reference.

BACKGROUND

1. Field of the Invention

This patent specification generally describes a method and apparatus for image forming. More particularly, this patent specification describes a method and apparatus for image forming capable of correcting a misregistration of an image in color in an effective and precise manner.

2. Background Art

In general, a background color image forming apparatus according to an electrophotographic method sequentially forms a plurality of images in primary colors and superimpose them one on another so as to form a full color image. The background apparatus employs an intermediate transfer process to transfer the sequentially formed primary color images into a complete full-color image. This process typically uses an intermediate transfer member (e.g., an intermediate transfer belt) onto which the sequentially formed primary color images are superimposed one on another. This method, however, may generate an image unevenness when transfer positions of the sequentially formed primary color images are shifted relative to the intermediate transfer member, resulting in a deterioration of an image quality.

One example of the background color image forming apparatus has attempted to correct a shift of the transfer position. This example background apparatus attempts to reduce a dirt, for example, a toner on an optical detection mechanism so as to improve a detection accuracy of a reference image of each color. Based on the accurate detection of reference image, the example background apparatus performs a color registration or a density control so as to create a high quality color image. This example background apparatus is simply provided with a slidable dirt cover with a detection hole. The slidable dirt cover is disposed between the detection mechanism and the transfer medium so as to protect a sensor of the detection mechanism from contaminants such as dirt particles of toner, paper, etc.

Another example of the background color image forming apparatus has attempted to correct the above-described shift of the transfer position by forming and detecting a test pattern on the intermediate transfer belt. However, the intermediate transfer belt is typically formed in, a loop shape, having a join portion extended along in a belt width direction. Such a joint portion may be of detectable sign and become a cause of an erroneous detection of the test pattern. The example background apparatus attempts to avoid a detection of a joint sign on the intermediate transfer belt as the test pattern. Accordingly, this example background apparatus reduces an occurrence of a malfunction caused by improper detection of a flaw on the belt or an omission of patch detection so that a correction control for the color shift may be provided. The example background color image forming apparatus forms a color matching patch on the intermediate transfer belt, and obtains positional relation information of each photoconductor from a color matching patch detection signal so as to control a color matching. The color matching patch detection signal is an electric signal converted from the color matching patch by an optical sensor which is disposed at a location where the color matching patch is not formed in a belt width direction.

To attempt to eliminate noise information of the sign excluding the patch in the belt width direction, the example background apparatus is further provided with a detection mechanism, a patch detection mechanism, and an elimination mechanism. The detection mechanism detects position information of the sign (e.g., the joint sign) in the belt width direction except for the patch. The patch detection mechanism detects the position information of the patch including the sign. The elimination mechanism eliminates the position information detected by the detection mechanism from the position information detected by the patch detection mechanism.

FIG. 1 illustrates a set of parallel patches PN101 of KMCY and a set of diagonal patches PN201 of KMCY as the patches on a transfer belt 510. The KMCY indicates colors of black, magenta, cyan, and yellow. As shown in FIG. 1, a combination of the parallel and diagonal patches has often be used. Thereby, the parallel and diagonal patches PN101 and PN201 of KMCY are formed on the transfer belt 510, and are detected by a position detector 200 (e.g., the optical sensor) so that the misregistration may be corrected.

However, the background color image forming apparatus having the patch detection mechanism has increased in complexity of a configuration thereof due to a digital process needed to detect positions of the patches PN101 and PN201 after an analog-to-digital conversion of the detection signal. The digital process includes a variety of processes which need a computation by a central processing unit (CPU) so that a CPU-load is increased. The transfer position is corrected based on misregistration information relating to the patch of each color which is formed in a traveling direction of an image carrying member (referred to as a sub-scanning direction). However, the transfer position may not be accurately corrected if the transfer belt 510 involves a rotational fluctuation.

SUMMARY

At least one embodiment of the present invention provides an image forming apparatus forming a full-color image with a plurality of primary color toners includes a plurality of image forming members, an image transfer member, a plurality of sensors, a calculator, an edge extractor, a counter, and a misregistration corrector. The plurality of image forming members each to form a plurality of test patches thereon. The image transfer member receives the plurality of test patches from each one of the plurality of image forming members. The plurality of sensors detects the plurality of test patches carried on the image transfer member. The calculator performs a logical operation (e.g., an exclusive-OR operation) relative to detection signals output by the plurality of sensors. The edge extractor detects edges and generates edge signals based upon an output signal of the calculator. The counter counts clock pulses with respect to the edge signals generated by the edge extractor to determine a length of each of the plurality of test patches detected. The misregistration corrector calculates time lags among the detection signals based on count values counted by the counter for the plurality of test patches detected and to correct misregistration of the full-color image based on the calculated time lags.

At least one embodiment of the present application provides a method of forming a full-color image with a plurality of primary color toners includes, providing an image transfer member and a plurality of sensors, forming a plurality of test patches on the image transfer member, detecting the plurality of test patches formed on the image transfer member with the plurality of sensors, performing a logical operation (e.g., an exclusive-OR operation) relative to detection signals output by the plurality of sensors, detecting edges and generating edge signals based upon an output signal of the logical operation, counting clock pulses with respect to the edge signals to determine a length of each of the plurality of test patches detected, calculating time lags among the detection signals based on count values counted by the counting step for the plurality of test patches detected, and correcting misregistration of the full-color image based on the calculated time lags.

Additional features and advantages of the present invention will be more fully apparent from the following detailed description of example embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of example embodiments when considered in connection with the accompanying drawings, wherein.

Figure 1:
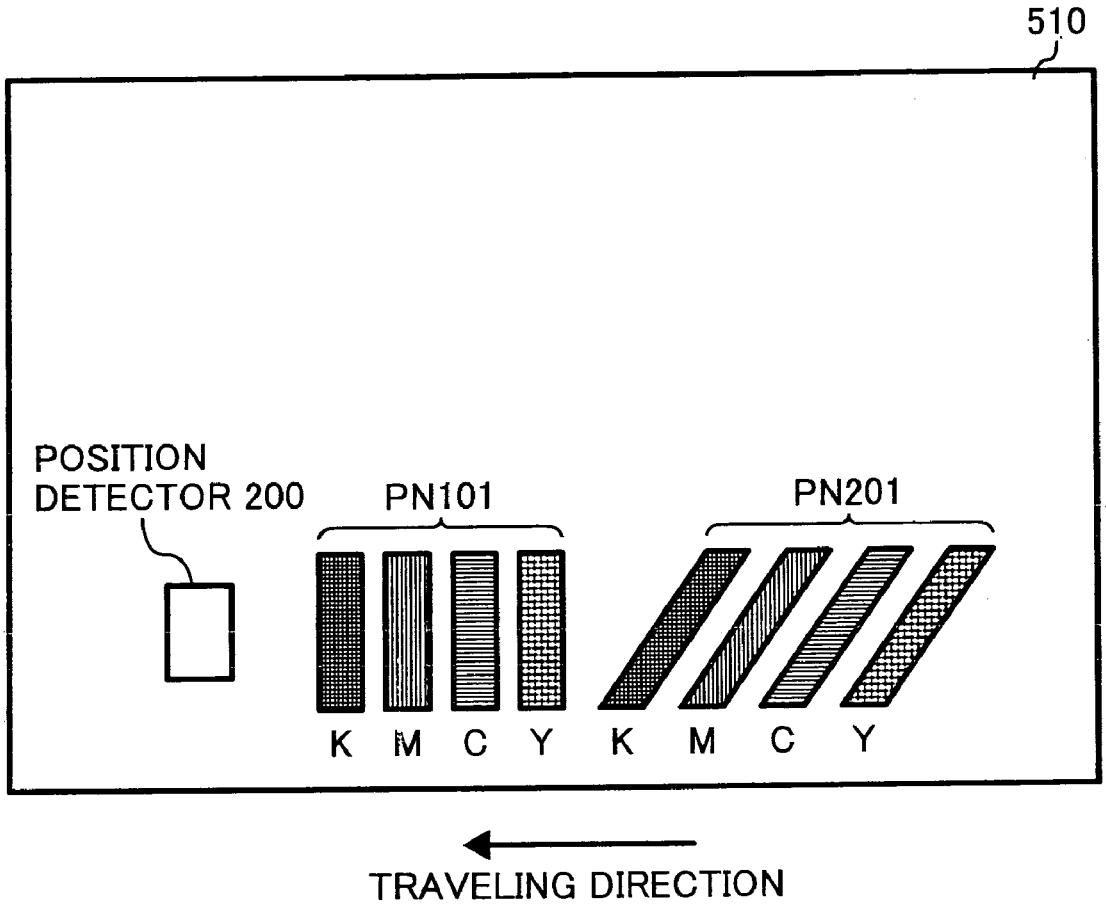
FIG. 1 BACKGROUND ART
FIG. 1 is a diagram illustrating examples of sets of detection patches of a background color image forming apparatus.

The accompanying drawings are intended to depict example embodiments of the present invention and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would hen be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to described various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Reference is now made to the drawings, wherein like reference numerals designate identical or corresponding parts throughout the several views.

Figure 2:
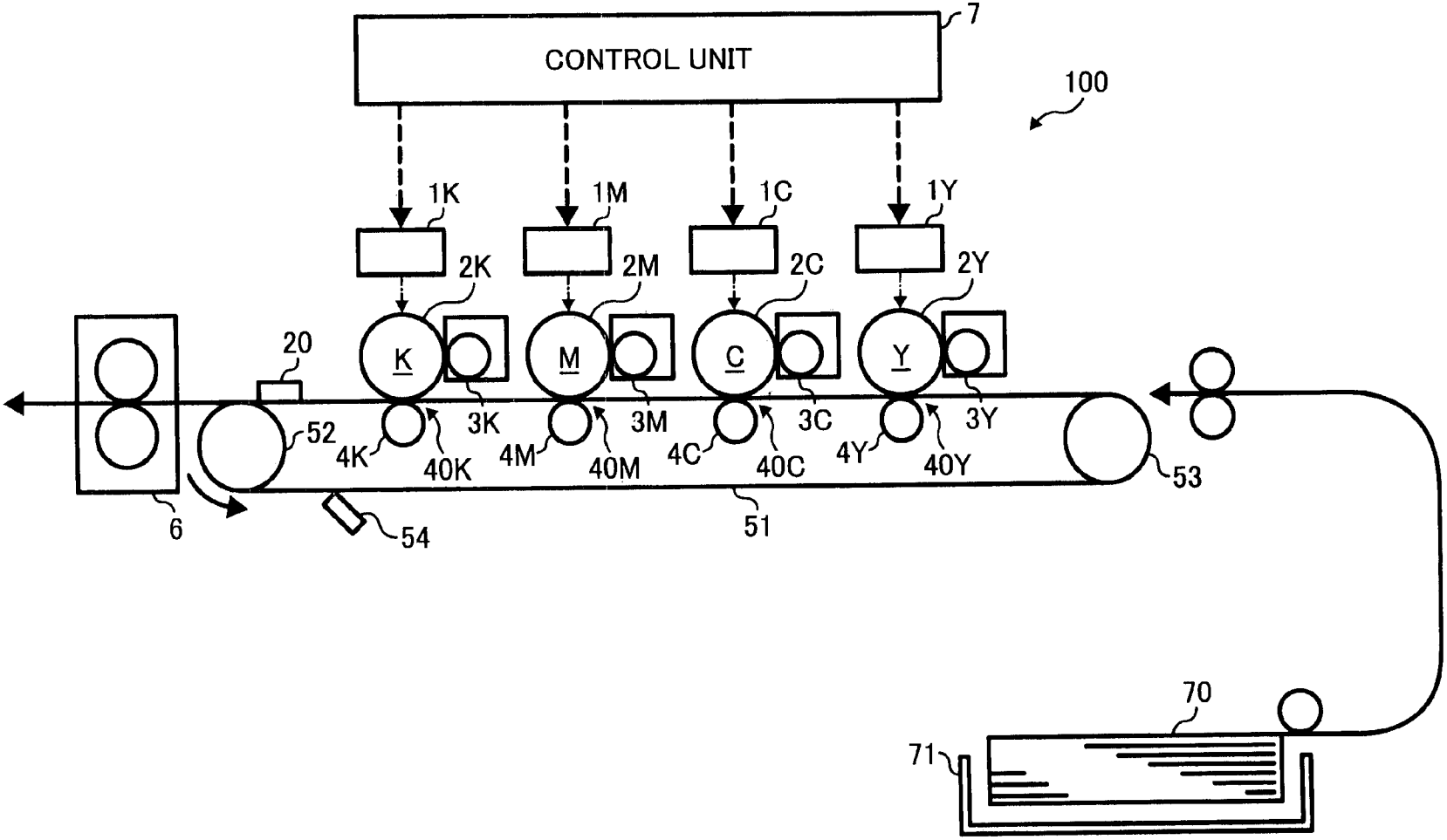
FIG. 2 is a schematic diagram illustrating an image forming unit and associated components of an image forming apparatus according to an example embodiment of the present invention.

FIG. 2 is a schematic diagram illustrating an image forming unit and associated components of an image forming apparatus according to an example embodiment of the present invention.

Referring to FIG. 2, the image forming apparatus capable of forming a color image with an electrophotographic method includes the image forming unit 100. The image forming unit 100 includes writing units 1K, 1M, 1C, and 1Y, photoconductors 2K, 2M, 2C, and 2Y, development devices 3K, 3M, 3C, and 3Y, transfer devices 4K, 4M, 4C, and 4Y, a transfer belt 51, a position detector 20, a drive roller 52, a cleaning device 54, and a driven roller 53. The image forming apparatus further includes a fixing unit 6, a control unit 7, and a sheet feeding cassette 71 which are disposed in a vicinity of the image forming unit 100.

The image forming apparatus of FIG. 2 forms a full color image with four primary color toners of black, magenta, cyan, and yellow. Throughout the drawings, several components associated with colors are labeled with reference numerals added with reference color symbols K, M, C, and Y for black, magenta, cyan, and yellow, respectively. In some cases, however, the reference color symbols K, M, C, and Y may be used or omitted as may be needed for explanation.

Each of the writing units 1K, 1M, 1C, and 1Y emits scanning laser light which is modulated according to image data of a corresponding primary color. The scanning laser light scans a surface of a corresponding photoconductor in a main scanning direction. Each of the photoconductors 2K, 2M, 2C, and 2Y is rotated in a sub-scanning direction perpendicular to the main scanning direction, and forms an electrostatic latent image of a corresponding primary color thereon. Each of the development devices 3K, 3M, 3C, and 3Y develops the electrostatic latent image so as to form a toner image of a corresponding primary color. Each of the transfer device 4K, 4M, 4C, and 4Y transfers a corresponding toner image onto a recording sheet 70. The transfer belt 51 is rotated in the sub-scanning direction to convey the recording sheet 70 and to sequentially transfer the toner images of black, magenta, cyan, and yellow into a full-color image.

The position detector 20 detects a transfer position of the image so as to detect a toner mark (referred to as a patch) on the transfer belt 51. The drive roller 52 drives the transfer belt 51. The cleaning device 54 removes an unnecessary toner image from the transfer belt 51. The driven roller 53 rotates the transfer belt 51. The control unit 7 decomposes image data and converts it into writing data. The fixing unit 6 fixes the toner images transferred on the recording sheet 70 by applying a heat and pressure. The sheet feeding cassette 71 stores a recording sheet 71. In addition to these components, transfer areas 40 are formed electro-photographically between the transfer belt 51 contacting each of the photoconductors and the transfer devices opposing to the photoconductors. The transfer areas 40 are regions in which toner images are transferred and superimposed on the recording sheet 71.

The image forming unit 100 of the example embodiment is a tandem style and is configured to employ a direct transfer system. In the direct transfer system of FIG. 2, the control unit 7 begins with decomposing the image data of an original into the image data of each of the four colors and converting the decomposed data into writing data of each of the four colors. The writing units 1K, 1M, 1C, and 1Y output laser lights to expose the photoconductors 2K, 2M, 2C, and 2Y so that the electrostatic latent images with respect to the image data are formed on surfaces of the photoconductors. The electrostatic latent images on the photoconductors surfaces are developed by the development devices 3K, 3M, 3C, and 3Y so that toner images of each of the four colors are formed. The recording sheet 70 which is electrostatically adsorbed to the transfer belt 51 is fed from the sheet feeding cassette 71 to the transfer areas 40 while the toner images developed by the development devices are provided to the transfer areas 40. Thereby, the toner images of the four colors are sequentially superimposed on the recording sheet 70 in the transfer areas 40 so as to form the color image.

The transfer belt 51 is an endless belt and is tightly stretched between the drive roller 52 and driven roller 53 so as to be driven at a constant speed by a motor (not shown) which is connected to an axis of the drive roller 52. The transfer belt 51 employs a belt all or a part of layers of which are formed by a fluorinated resin, a polycarbonate resin, and a polyimide resin, for example. The cleaning device 54 is disposed in a downstream side in a rotation direction of the transfer belt 51 of the drive roller 52. The fixing unit 6 is disposed in a downstream side in a conveyance direction of the transfer belt 51. The position detector 20 (referred to as a toner mark sensor) is disposed in a downstream side of the transfer device 4K. When the position detector 20 employs an optical sensor, the transfer belt 51 is irradiated with a light so that the toner mark generated on the transfer belt 51 is detected for measuring a color shift amount. Thereby, information for measuring the color shift amount is obtained. An example of the toner marks, for example, referred to as sets of patches PN101 and PN201 in FIG. 1 is explained with FIG. 1 in the Background Art. A reflection type of the optical sensor is employed as the position detector 20. FIG. 2 shows the image forming unit 100 of the image forming apparatus employing the direct transfer system. However, the image forming unit 100 may be applied to an indirect transfer system.

Figure 3:
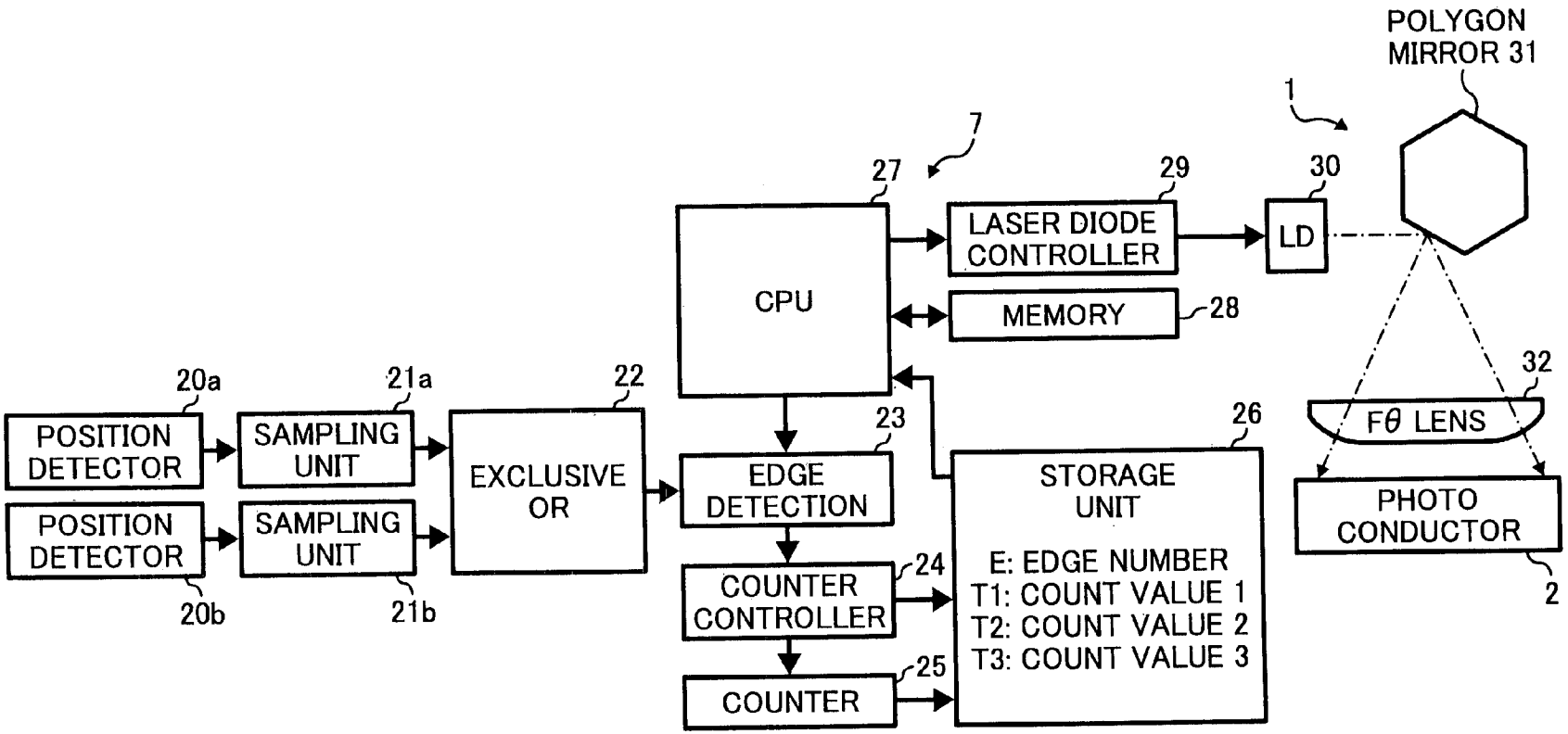
FIG. 3 is a block diagram illustrating in more detail (according to an example embodiment of the present invention) a process circuit and an optical scanning system of the image forming apparatus illustrated in FIG. 2.

FIG. 3 is a block diagram illustrating a process circuit and an optical scanning system of the image forming apparatus illustrated in FIG. 2.

Referring to FIG. 3, the control unit 7, position detector 20, writing unit 1 and photoconductor 2 of FIG. 2 are illustrated to explain the process circuit. In this example embodiment, the control unit 7 corresponds to a CPU 27, the edge detection circuit 23, a counter controller 24, a counter 25, a storage unit 26, a memory 28, and a laser diode controller 29 while the writing unit 1 corresponds to a laser diode (LD) 30, a polygon mirror 31, an Fθ lens 32, and the photoconductor 2. The position detector 20 includes a first position detector 20*a* and a second position detector 20*b*. In latter stages of the position detectors 20*a* and 20*b*, sampling units 21*a* and 21*b* and a logical operation unit 22 are provided. For example, logical operation unit 22 can be a combinational logic unit such as an exclusive-OR unit, and is referred hereafter to as exclusive-OR unit 22.

In the process circuit of this example embodiment, the position information is detected by the position detectors 20*a* and 20*b*, and outputs of the detectors 20*a* and 20*b* are respectively sampled by the sampling units 21*a* and 21*b*. The exclusive-OR unit 22 performs exclusive-OR operation with respect to outputs of the sampling units 21*a* and 21*b*. The edge detection circuit 23 performs edge detection on an output of the exclusive-OR unit 22. In latter stages of the edge detection circuit 23, the counter controller 24 and counter 25 are provided.

The CPU 27 is connected to the edge detection circuit 23. The CPU 27 outputs a control signal to the edge detection circuit 23 while receiving data (which will be described later) input from the storage unit 26 so that emission timing of the LD 30 is controlled through the laser diode controller 29 based on a program and control data stored in the memory 28. A laser light emitted from the ID 30 is scanned by the polygon mirror 31, and an appropriate correction is made to the laser light thereof by the Fθ lens 32 so that an optical writing is performed on the photoconductor 2.

Figure 4:
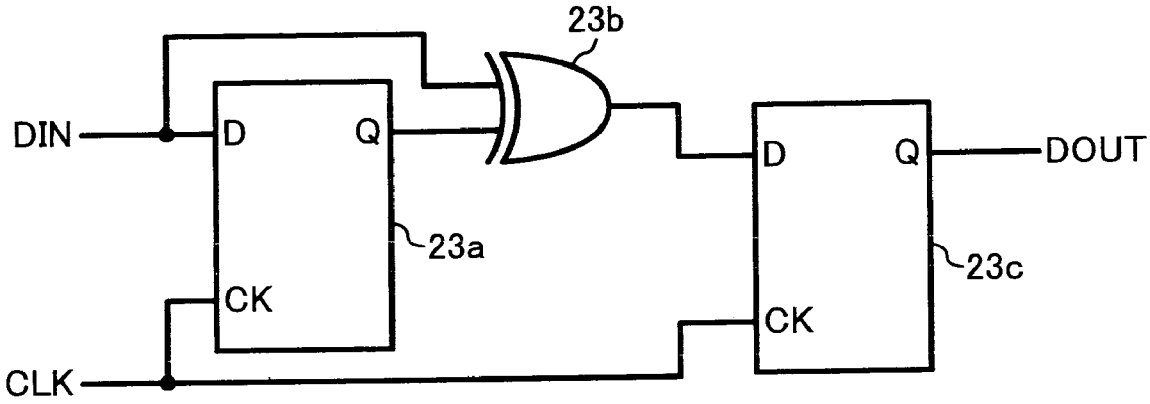
FIG. 4 is a schematic diagram (according to an example embodiment of the present invention) of an edge detection circuit of the process circuit illustrated in FIG. 3.

FIG. 4 shows an example of a schematic diagram of an edge detection circuit of the process circuit illustrated in included in FIG. 3.

Referring to FIG. 4, the edge detection circuit 23 includes a first flip-flop 23*a*, an exclusive-OR (XOR) gate 23*b*, and a second flip-flop 23*c*. The output signal of the exclusive-OR unit 22 is input from a DIN, and a sampling clock is input to a CLK. Thereby, an edge signal is output from a DOUT of the second flip-flop 23*c*.

Figure 5:
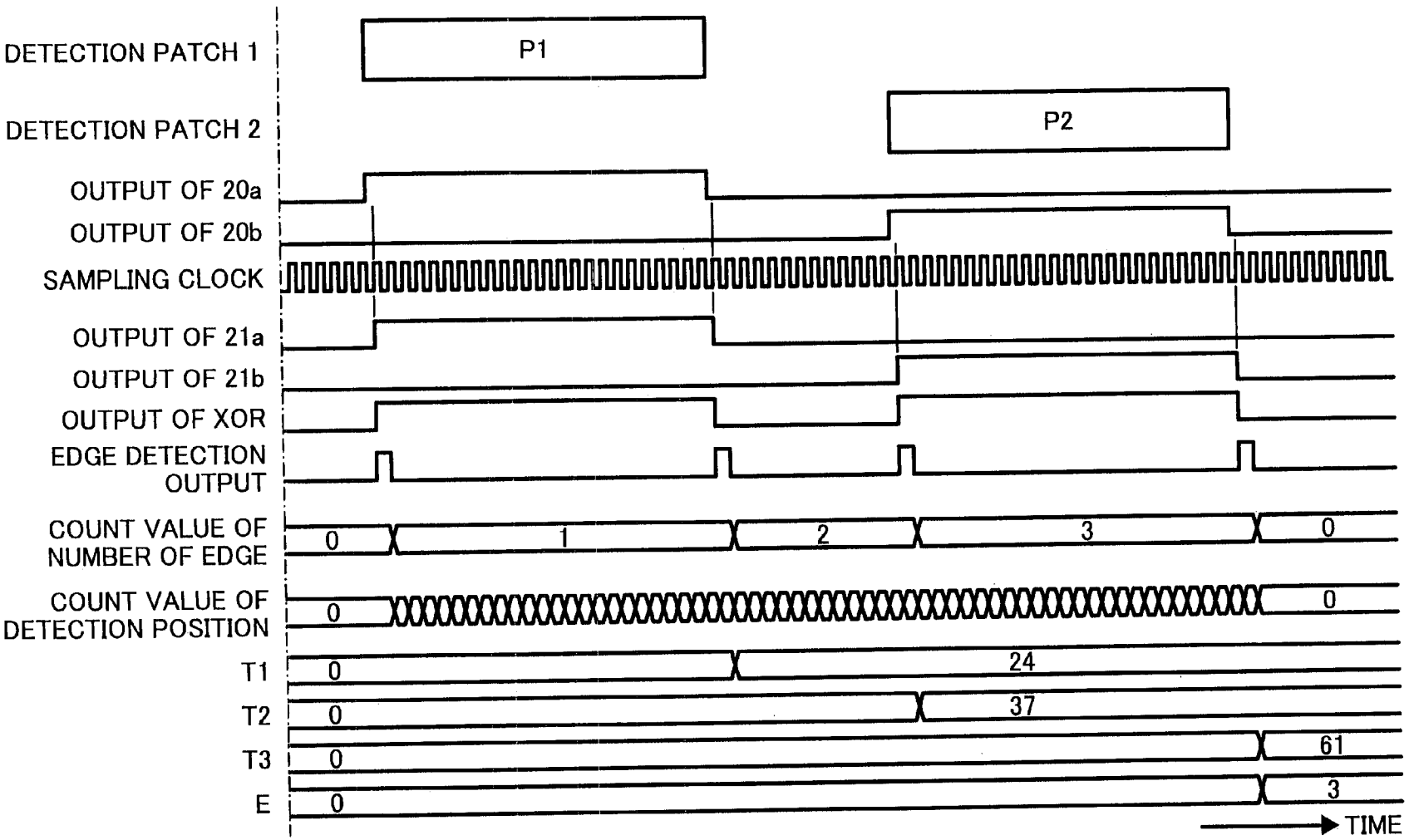
FIG. 5 is a timing chart (according to an example embodiment of the present invention) illustrating timings of reading two position detection patches.
Figure 6:
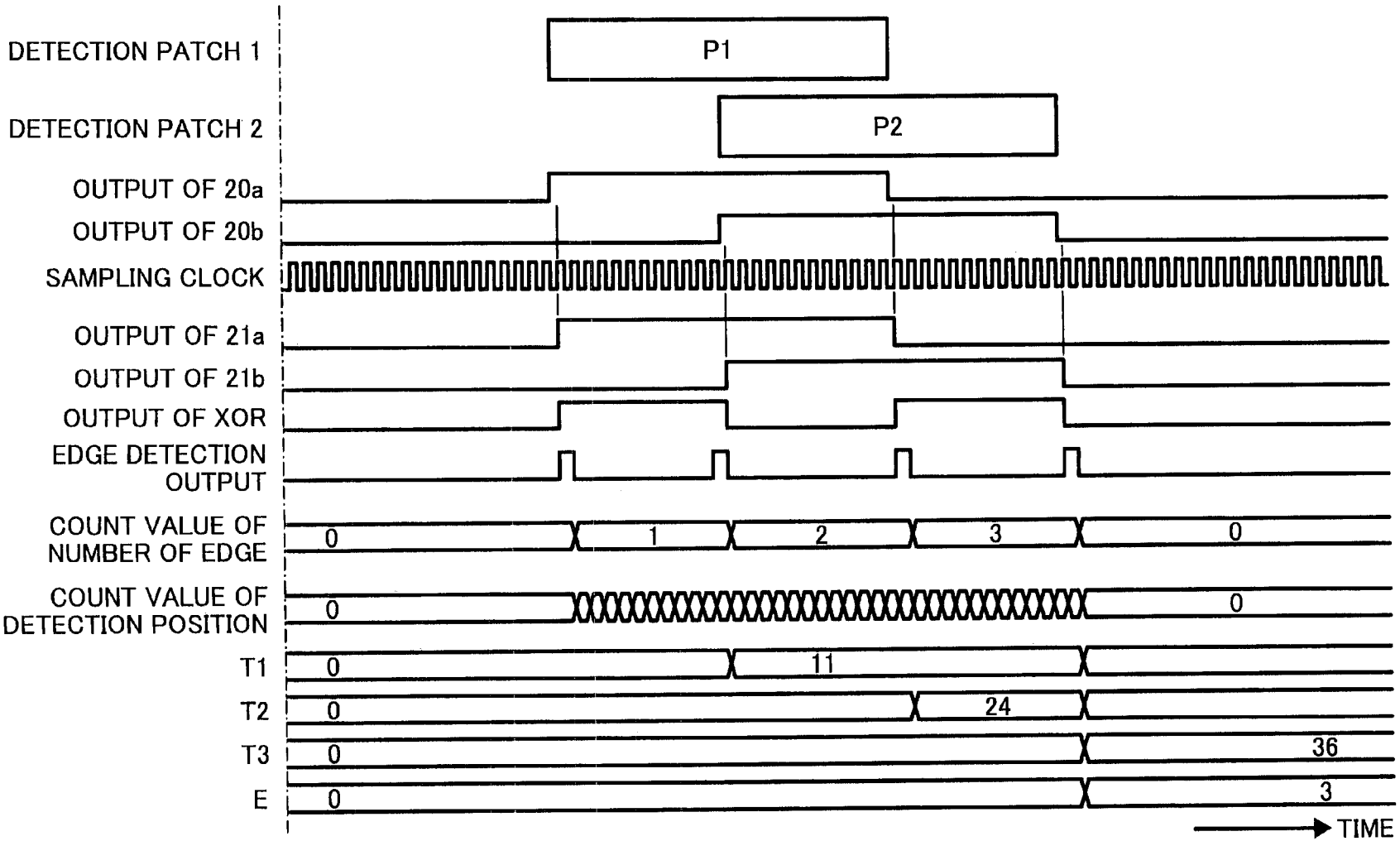
FIG. 6 is a timing chart (according to an example embodiment of the present invention) illustrating different timings of reading two position detection patches.

FIGS. 5 and 6 are timing charts illustrating timing of reading two position detection patches P1 and P2, for example.

Referring to FIG. 5, the output signals from the first and second position detectors 20*a* and 20*b* are sampled by the sampling clock. The exclusive-OR unit 22 performs the exclusive-OR operation to the output signals sampled by the sampling clock so as to output the signal which is indicated as an "output of XOR" in FIG. 5. The output of the exclusive-OR unit 22 is input to the edge detection circuit 23. The edge detection signal is output from the edge detection circuit 23 and is indicated as an "edge detection output" as shown in FIG. 5. This edge detection signal is input to the counter controller 24 so that the counter 25 and storage unit 26 are controlled. An example procedure of the counter controller 24 will be given with reference to FIG. 7.

The timing chart of FIG. 5 shows relationships among count values T1-T3 relative to the patches P1 and P2. Specifically, the count value T1 is congruent with a length of the patch P1, and a difference of the count values T3 and T2, i.e., (T3−T2), is congruent with a length of the patch P2. Thereby, the count value T2 indicates a misregistration amount of the patches P1 and P2 and a length of misregistration can be expressed by a formula 1:

$$T2\times(1/F)\times S,$$

where F is a sampling frequency and S is a speed of the intermediate transfer belt. The transfer position may be corrected based on information relating to the misregistration.

Referring to FIG. 6, another timing chart is illustrated. This timing chart is similar to that of FIG. 5. However, the outputs which read the two detection patches P1 and P2 are input at different timings. Thereby, the count value T2 and a differential count value (T3−T1) are respectively congruent with a length of the patch P1 and a length of the patch P2 as shown in FIG. 6. The count value T1 indicates the misregistration amount of the patches P1 and P2.

Figure 7:
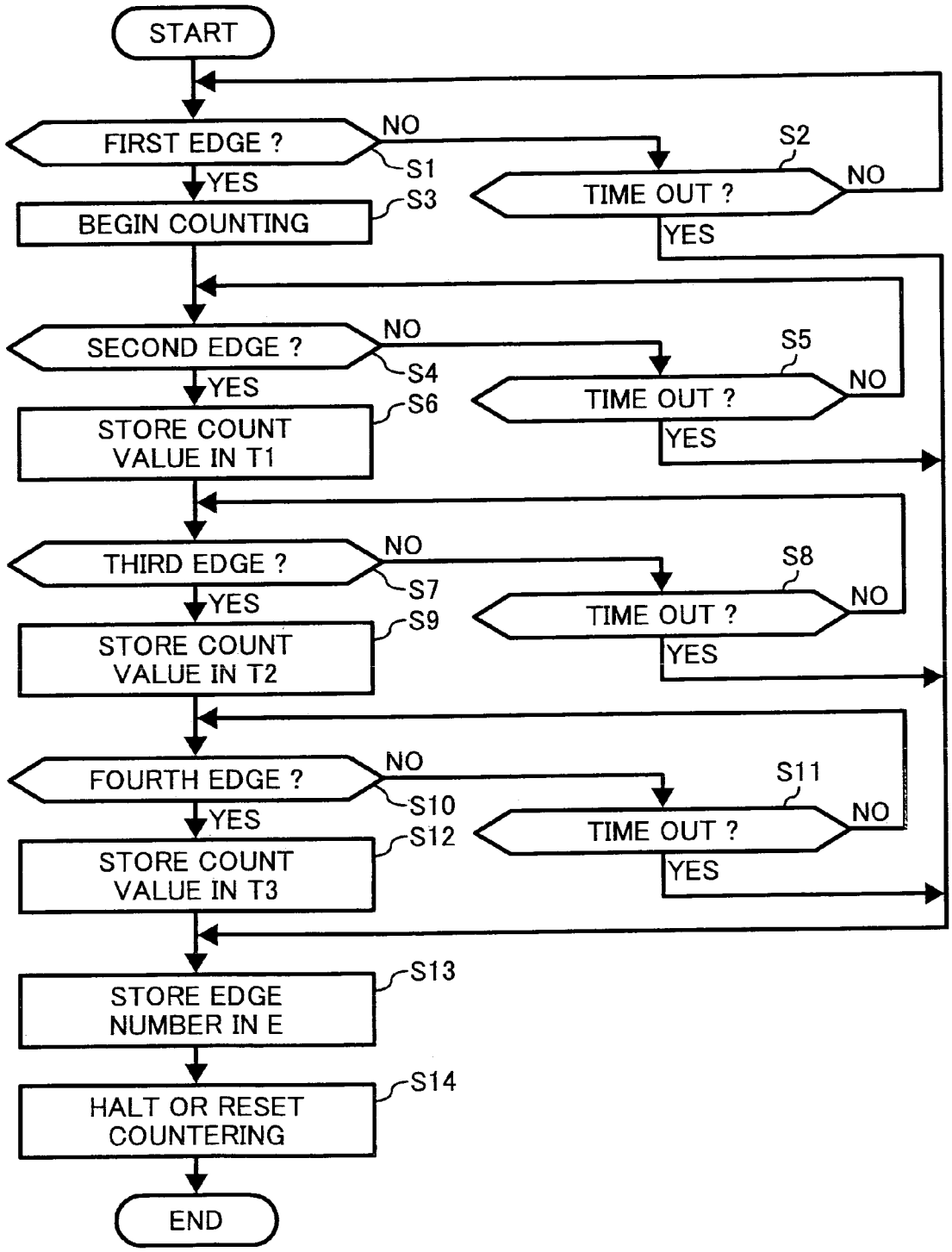
FIG. 7 is a flowchart illustrating (according to an example embodiment of the present invention) an example procedure to perform a control operation by a counter controller of the process circuit of FIG. 3.

FIG. 7 is a flowchart illustrating an example procedure to perform a control operation by the counter controller of the process circuit of FIG. 3. This example procedure is to obtain a number of an edge and a respective count value. A maximum number of the edge obtained from the exclusive-OR of the two patches is 4.

Referring to FIG. 7, the example procedure begins with detection of a first edge at steps S1 and S2. When the first edge is detected, an operation of the counter is begun at a step S3. When a second edge is detected at steps S4 and S5, a count value is stored in a count value 1 (T1) of the storage unit 26 at a step S6. When a third edge is detected at steps S7 and S8, a count value is stored in a count value 2 (T2) of the storage unit 26 at a step S9. When a last and fourth edge is detected at steps S10 and S11, a count value is stored in a count value 3 (T3) of the storage unit 26 at a step 12. A detected number of the edge is stored in an E area of the storage unit 26 at step 13, and the operation of the counter is halted or reset at a step 14. Thereby, the edge number and count values are obtained.

Figure 8:
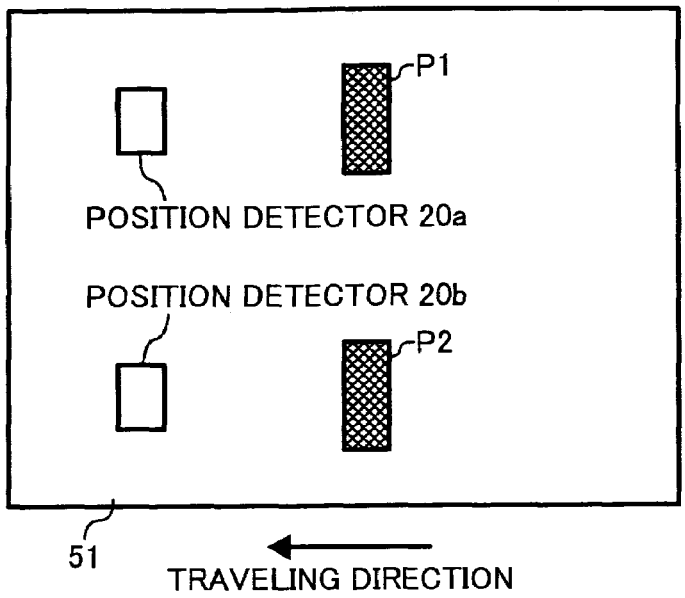
FIG. 8 is an illustration (according to an example embodiment of the present invention) of an example arrangement of a first patch and a second patch and a relationship between a first position detector and a second position detector.

FIG. 8 is an illustration illustrating an example arrangement of the patches P1 and P2 and a relationship between the first and second position detectors 20*a* and 20*b* in an arrangement.

Referring to FIG. 8, a direction of an arrow indicates a traveling direction of the transfer belt 51, and the patches and position detectors 20*a* and 20*b* are arranged so as to be perpendicular to the traveling direction. FIG. 8 shows the arrangement in which the position detection patches P1 and P2 of a same color are formed on the transfer belt 51 at same timing. In other words, FIG. 8 shows an example case where the patches P1 and P2 are formed with one of the KMCY colors in FIG. 1 at the same timing. These position detection patches P1 and P2 are exposed to the light at the same timing so that image forming positions are the same. However, in a case where an error exists in at least one of mounting locations of the position detectors, theses patches are misregistrated. The mounting location having the error should be corrected so that at least one of image transfer positions may be corrected by obtaining the position information of the patches P1 and P2 which are used as correction information relating to the mounting locations.

Figure 9:
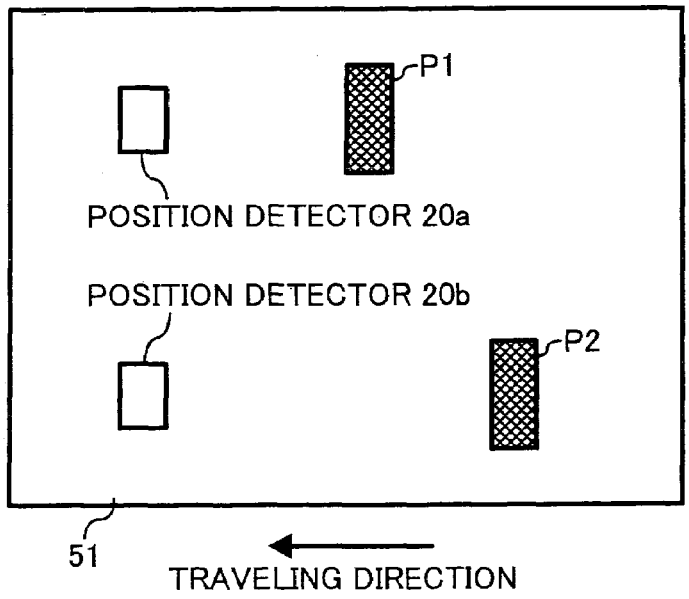
FIG. 9 is an illustration (according to an example embodiment of the present invention) of another example arrangement of the first and second patches relative to the first and second position detectors.

FIG. 9 is an illustration illustrating another example arrangement of the patches P1 and P2 and relative to the first and second position detectors.

Referring to FIG. 9, the position detection patches P1 and P2 of different colors are formed at the same timing. These patches are exposed to the light at the same timing. However, the toner images are transferred in misregistered positions on the transfer belt 51 because different colors of the images are formed as may be seen in FIG. 1. An amount of the misregistration on the transfer belt 51 is an pitch amount of the photoconductors 2 in FIG. 2. The pitch between two photoconductors are designed to be determined. However, the transfer position may be misregistered by the error of at least one of the mounting locations of the photoconductors 2, for example. The position information relating to these patches is obtained so that the misregistration of the transfer position may be detected.

FIG. 10 through FIG. 26 illustrate 17 different timing patterns of the detection patches P1 and P2 so that the position information relating to the position detection patches may be accurately identified. Each of these 17 patterns shows a situation where at least one detection patch is formed a plurality of times in the traveling direction of the transfer belt 51, a length of the at least one detection patch which is formed the plurality of times is greater than that of another detection patch, and an interval of the at least one detection patch which is formed the plurality of times is greater than that of another detection patch.

Each of the 17 different patterns has respective detection conditions which will be given later. Reference symbols used for explaining these patterns are as follows.

P1: the patch length of the first detection patch

P2: the patch length of the second detection patch

P2D: a patch interval of the second detection patches

E: the edge detection number

T1 to T5: the count value

Figure 10:
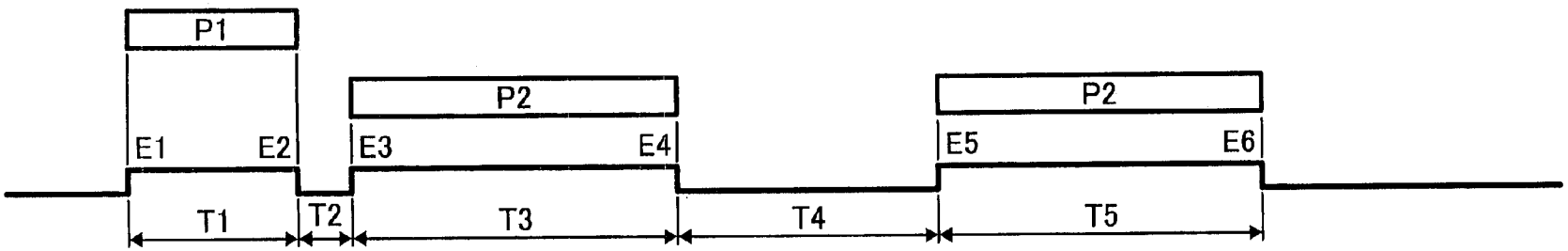
FIG. 10 illustrates (according to an example embodiment of the present invention) a first pattern of detection patches.

Referring to FIG. 10, a first pattern of the patches P1 and P2 is illustrated, and detection conditions thereof are as follows.

E=6 & T1=P1 & T3=P2 & T4=P2D & T5=P2, where the edge detection number is 6 of E1 to E6, the count value T1 is equivalent to the length of the first detection patch P1, the count value T3 is equivalent to the length of the second detection patch P2, the count value T4 is equivalent to the patch interval of the second detection patches P2*s*, and the count value T5 is equivalent to the length of the second detection patch P2.

Figure 11:
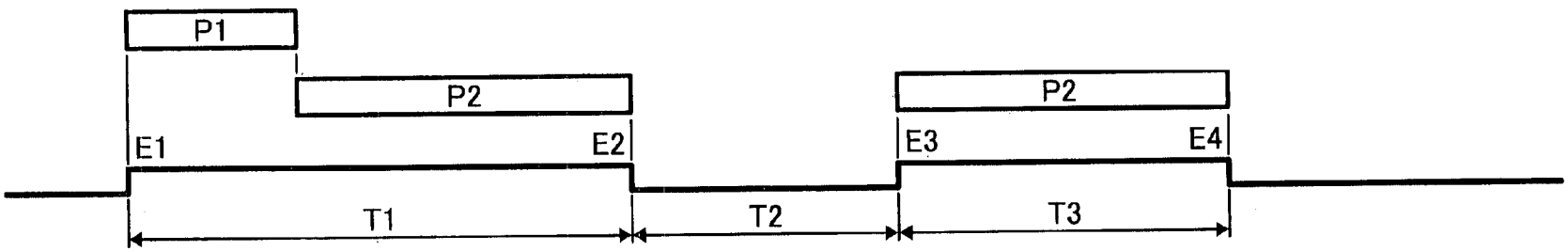
FIG. 11 illustrates (according to an example embodiment of the present invention) a second pattern of the detection patches.

Referring to FIG. 11, a second pattern of the detection patches P1 and P2 is illustrated, and detection conditions thereof are as follows.

E=4 & T1=P1+P2 & T2=P2D & T3=P2, where the edge detection number is 4 of E1 to E4, the count value T1 is equivalent to a sum of lengths of the first and second detection patches P1 and P2, the count value T2 is equivalent to the patch interval of the second detection patches P2*s*, and the count value T3 is equivalent to the length of the second detection patch P2.

Figure 12:
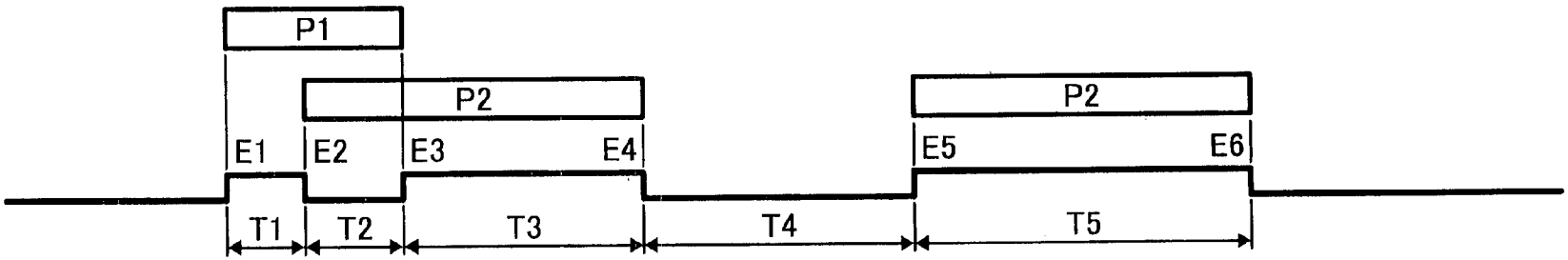
FIG. 12 illustrates (according to an example embodiment of the present invention) a third pattern of the detection patches.

Referring to FIG. 12, a third pattern of the detection patches P1 and P2 is illustrated, and detection conditions thereof are as follows.

E=6 & T4=P2D & T5=P2 & T1+T2=P1 & T2+T3=P2, where the edge detection number is 6 of E1 to E6, the count value T4 is equivalent to the patch interval of the second detection patches P2*s*, the count value T5 is equivalent to the length of the second detection patch P2, a sum of the count values T1 and T2 is equivalent to the length of the first detection patch P1, and a sum of the count values T2 and T3 is equivalent to the length of the second detection patch P2.

Figure 13:
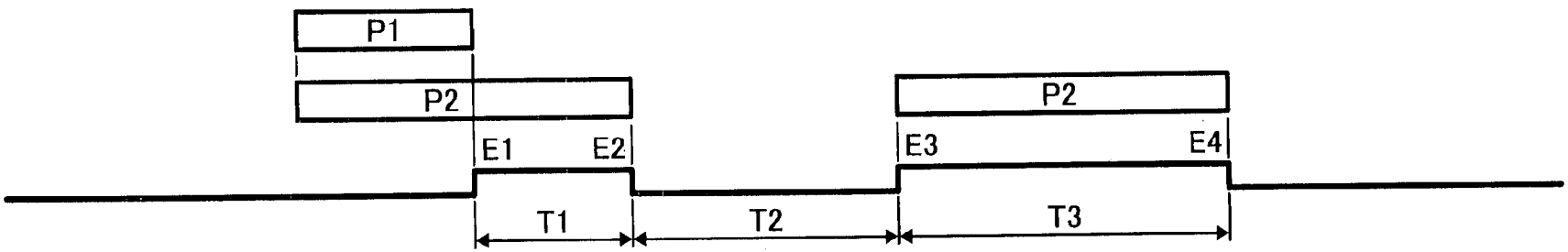
FIG. 13 illustrates (according to an example embodiment of the present invention) a forth pattern of the detection patches.

Referring to FIG. 13, a fourth pattern of the detection patches P1 and P2 is illustrated, and detection conditions thereof are as follows.

E=4 & T1=P2−P1 & T2=P2D & T3=P2, where the edge detection number is 4 of E1 to E4, the count value T1 is equivalent to a difference between lengths of the first and second detection patches P1 and P2, the count value T2 is equivalent to the patch interval of the second detection patches P2*s*, and the count value T3 is equivalent to the length of the second detection patch P2.

Figure 14:
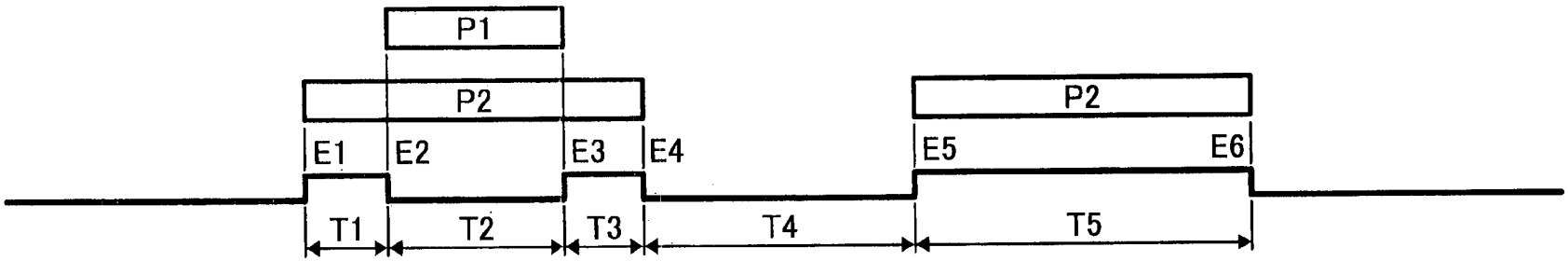
FIG. 14 illustrates (according to an example embodiment of the present invention) a fifth pattern of the detection patches.

Referring to FIG. 14, a fifth pattern of the detection patches P1 and P2 is illustrated, and detection conditions thereof are as follows.

E=6 & T2=P1 & T4=P2D & T5=P2 & T1+T2+T3=P2, where the edge detection number is 6 of E1 to E6, the count value T2 is equivalent to the length of the first detection patch P1, the count value T4 is equivalent to the patch interval of the second detection patches P2*s*, the count value T5 is equivalent to the length of the second detection patch P2, and a sum of the count values T1 and T2 is equivalent to the length of the second detection patch P2.

Figure 15:
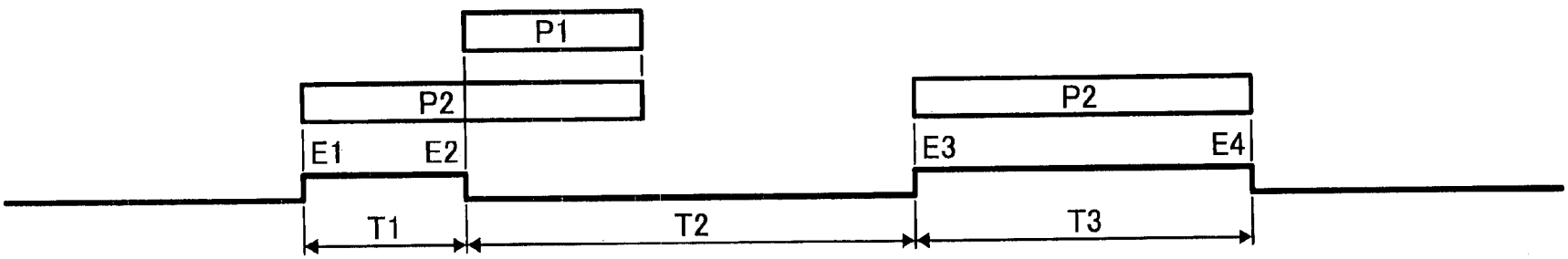
FIG. 15 illustrates (according to an example embodiment of the present invention) a sixth pattern of the detection patches.

Referring to FIG. 15, a sixth pattern of the detection patches P1 and P2 is illustrated, and detection conditions thereof are as follows.

E=4 & T1=P2−P1 & T2=P1+P2D & T3=P2, where the edge number is 4 of E1 to E4, the count value T1 is equivalent to a difference between lengths of the first and second detection patches P1 and P2, the count value T2 is equivalent to a sum of the length of the first detection patch P1 and the patch interval of the second detection patches P2*s*, and the count value T3 is equivalent to the length of the second detection patch P2.

Figure 16:
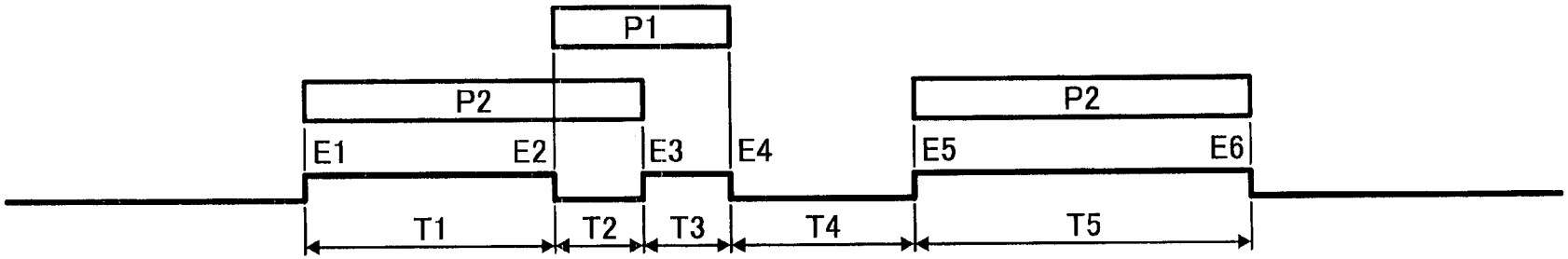
FIG. 16 illustrates (according to an example embodiment of the present invention) a seventh pattern of the detection patches.

Referring to FIG. 16, a seventh pattern of the detection patches P1 and P2 is illustrated, and detection conditions thereof are as follows.

E=6 & T5=P2 & T1+T2=P2 & T2+T3=P1 & T3+T4=P2D, where the edge detection number is 6 of E1 to E6, the count value T5 is equivalent to the length of the second detection patch P2, a sum of the count values T1 and T2 is equivalent to the length of the second detection patch P2, a sum of the count values T2 and T3 is equivalent to the length of the first detection patch P1, and a sum of the count values T3 and T4 is equivalent to the patch interval of the second detection patches P2*s*.

Figure 17:
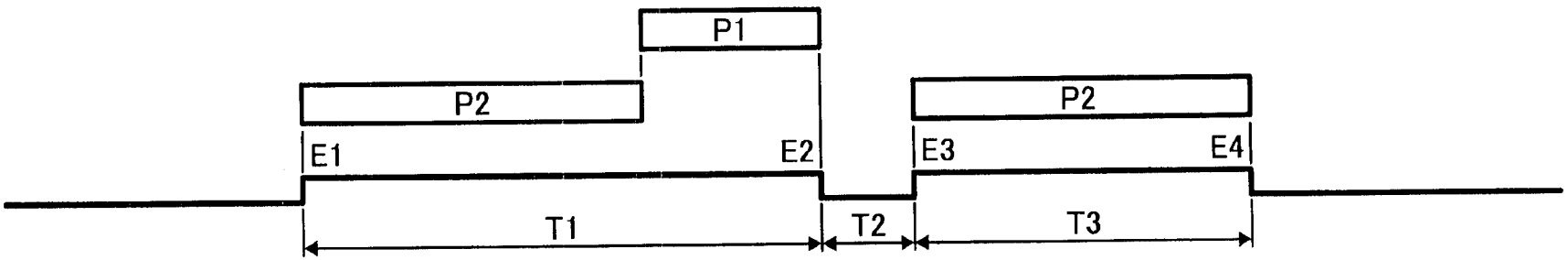
FIG. 17 illustrates (according to an example embodiment of the present invention) an eighth pattern of the detection patches.

Referring to FIG. 17, an eighth pattern of the detection patches P1 and P2 is illustrated, and detection conditions thereof are as follows.

E=4 & T1=P1+P2 & T2=P2D−P1 & T3=P2, where the edge detection number is 4 of E1 to E4, the count value T1 is equivalent to a sum of the lengths of the first and second detection patches P1 and P2, the count value T2 is equivalent to a difference of the patch interval of the second detection patches P2*s* and the length of the first detection patch P1, and the count values T3 is equivalent to the length of the second detection patch P2.

Figure 18:
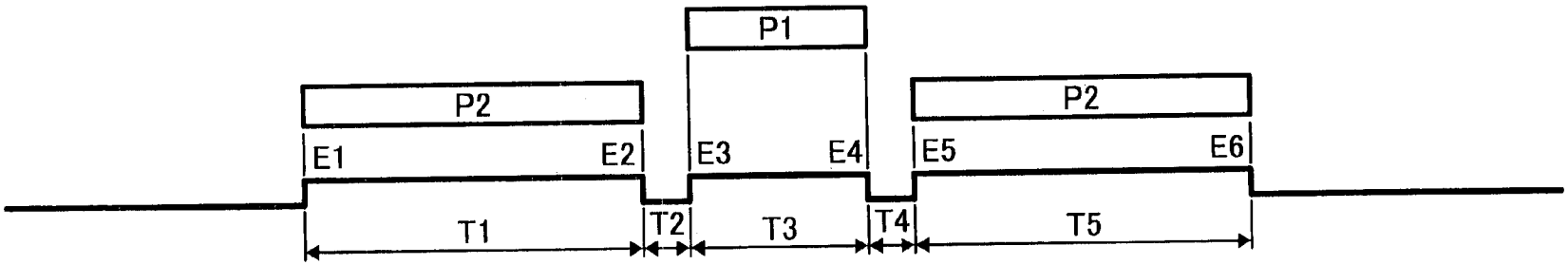
FIG. 18 illustrates (according to an example embodiment of the present invention) a ninth pattern of the detection patches.

Referring to FIG. 18, a ninth pattern of the detection patches P1 and P2 is illustrated, and detection conditions thereof are as follows.

E=6 & T1=P2 & T3=P1 & T5=P2 & T2+T3+T4=P2D, where the edge detection number is 6 of E1 to E6, the count value T1 is equivalent to the length of the second detection patch P2, the count value T3 is equivalent to the length of the first detection patch P1, the count value T5 is equivalent to the length of the second detection patch P2, and a sum of the count values T2, T3, and T4 is equivalent to the patch interval of the second detection patches P2*s*.

Figure 19:
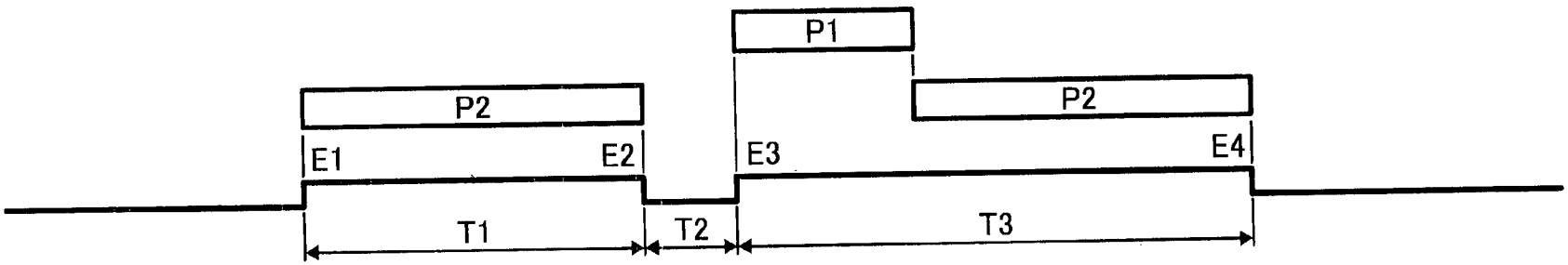
FIG. 19 illustrates (according to an example embodiment of the present invention) a tenth pattern of the detection patches.

Referring to FIG. 19, a tenth pattern of the detection patches P1 and P2 is illustrated, and detection conditions thereof are as follows.

E=4 & T1=P2 & T2=P2D−P1 & T3=P1+P2, where the edge detection number is 4 of E1 to E4, the count value T1 is equivalent to the length of the second detection patch P2, the count value T2 is equivalent to a difference between the patch interval of the second detection patches P2*s* and the length of the first detection patch P1, and the count value T3 is equivalent to a sum of the lengths of the first and second detection patches P1 and P2.

Figure 20:
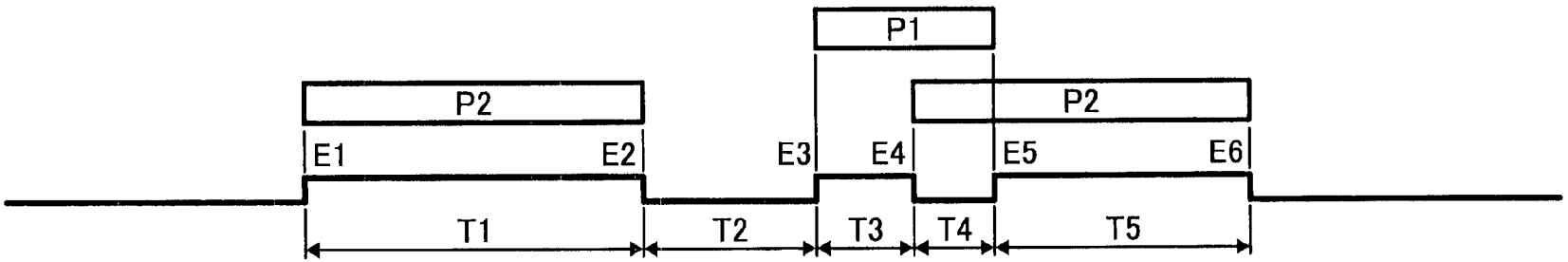
FIG. 20 illustrates (according to an example embodiment of the present invention) an eleventh pattern of the detection patches.

Referring to FIG. 20, an eleventh pattern of the detection patches P1 and P2 is illustrated, and detection conditions thereof are as follows.

E=6 & T1=P2 & T2+T3=P2D & T3+T4=P1 & T4+T5=P2, where the edge detection number is 6 of E1 to E6, the count value T1 is equivalent to the length of the second detection patch P2, a sum of the count values T2 and T3 is equivalent to the patch interval of the second detection patches P2*s*, a sum of the count values T3 and T4 is equivalent to the length of the first detection patch P1, and a sum of the count values T4 and T5 is equivalent to the length of the second detection patch P2.

Figure 21:
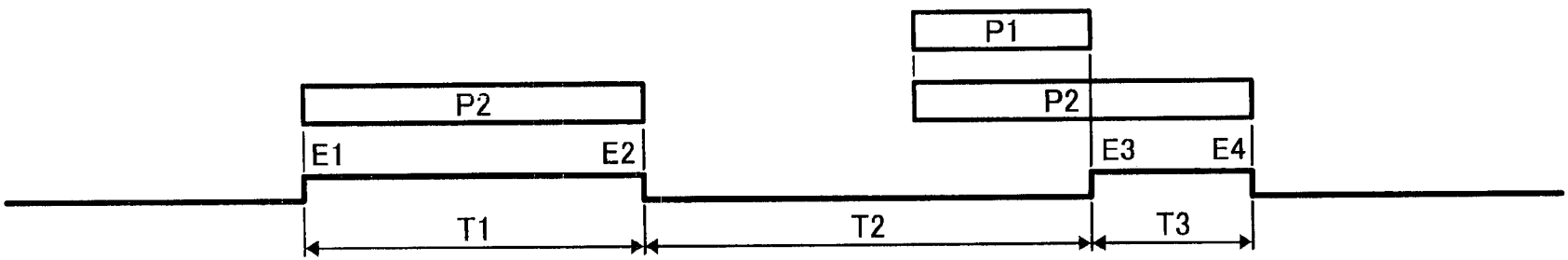
FIG. 21 illustrates (according to an example embodiment of the present invention) a twelfth pattern of the detection patches.

Referring to FIG. 21, a twelfth pattern of the detection patches P1 and P2 is illustrated, and detection conditions thereof are as follows.

E=4 & T1=P2 & T2=P1+P2D & T3=P2−P1, where the edge detection number is 4 of E1 to E4, the count value T1 is equivalent to the length of the second detection patch P2, the count value T2 is equivalent to a sum of the length of the first detection patch P1 and the patch interval of the second detection patches P2*s*, and the count value T3 is equivalent to a difference between the lengths of the first and second detection patches P1 and P2.

Figure 22:
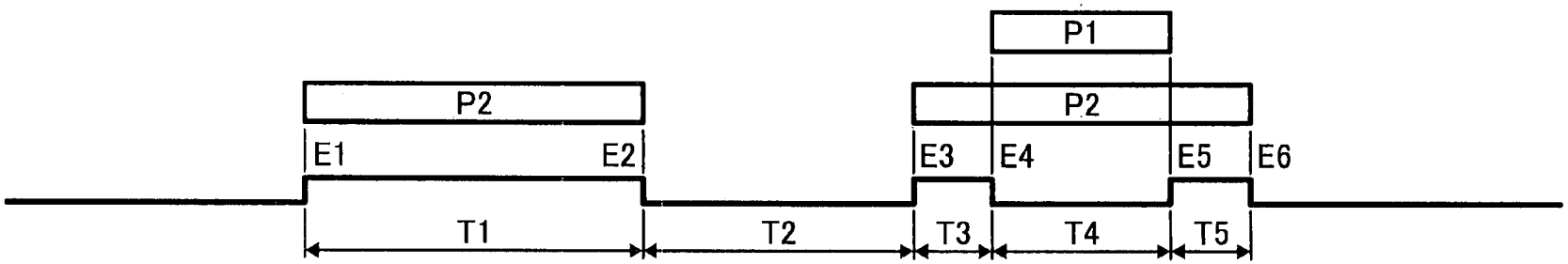
FIG. 22 illustrates (according to an example embodiment of the present invention) a thirteenth pattern of the detection patches.

Referring to FIG. 22, a thirteenth pattern of the detection patches P1 and P2 is illustrated, and detection conditions thereof are as follows.

E=6 & T1=P2 & T2=P2D & T4=P1 & T3+T4+T5=P2, where the edge detection number is 6 of E1 to E6, the count value T1 is equivalent to the length of the second detection patch P2, the count value T2 is equivalent to the patch interval of the second detection patches P2*s*, the count value T4 is equivalent to the length of the first detection patch P1, and a sum of the count values T3, T4, and T5 is equivalent to the length of the second detection patch P2.

Figure 23:
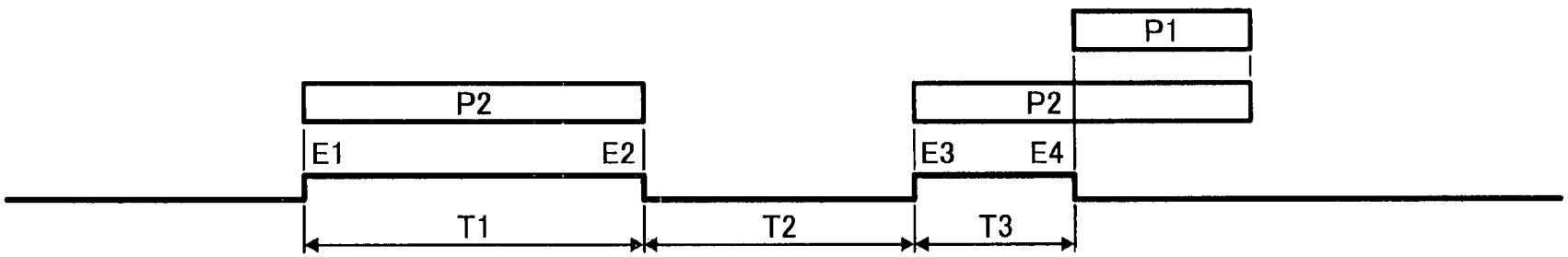
FIG. 23 illustrates (according to an example embodiment of the present invention) a fourteenth pattern of the detection patches.

Referring to FIG. 23, a fourteenth pattern of the detection patches P1 and P2 is illustrated, and detection conditions thereof are as follows.

Figure 24:
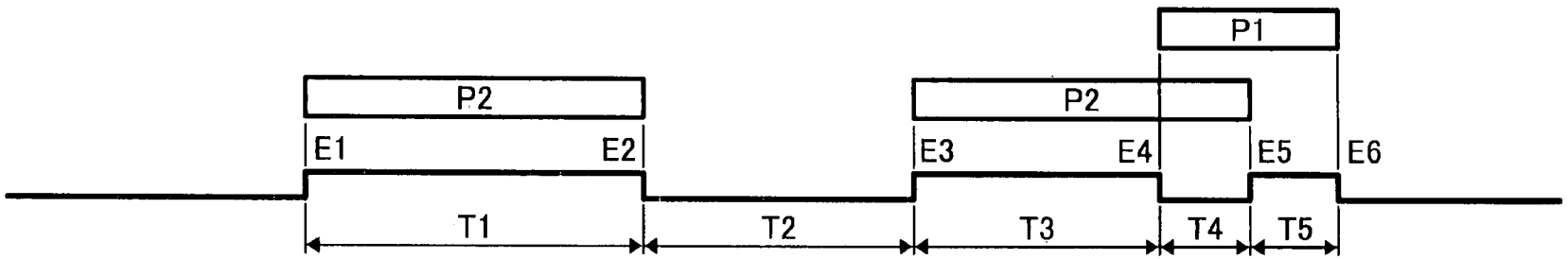
FIG. 24 illustrates (according to an example embodiment of the present invention) a fifteenth pattern of the detection patches.

E=4 & T1=P2 & T2=P2D & T3=P2−P1, where the edge detection number is 4 of E1 to E4, the count value T1 is equivalent to the length of the second detection patch P2, the count value T2 is equivalent to the patch interval of the second detection patches P2*s*, and the count value T3 is equivalent to a difference between the lengths of the first and second detection patches P1 and P2. Referring to FIG. 24, a fifteenth pattern of the detection patches P1 and P2 is illustrated, and detection conditions thereof are as follows.

E=6 & T1=P2 & T2=P2D & T3+T4=P2 & T4+T5=P1, where the edge detection number is 6 of E1 to E6, the count value T1 is equivalent to the length of the second detection patch P2, the count value T2 is equivalent to the patch interval of the second detection patches P2*s*, a sum of the count values T3 and T4 is equivalent to the length of the second detection patch P2, and a sum of the count values T4 and T5 is equivalent to the length of the first detection patch P1.

Figure 25:
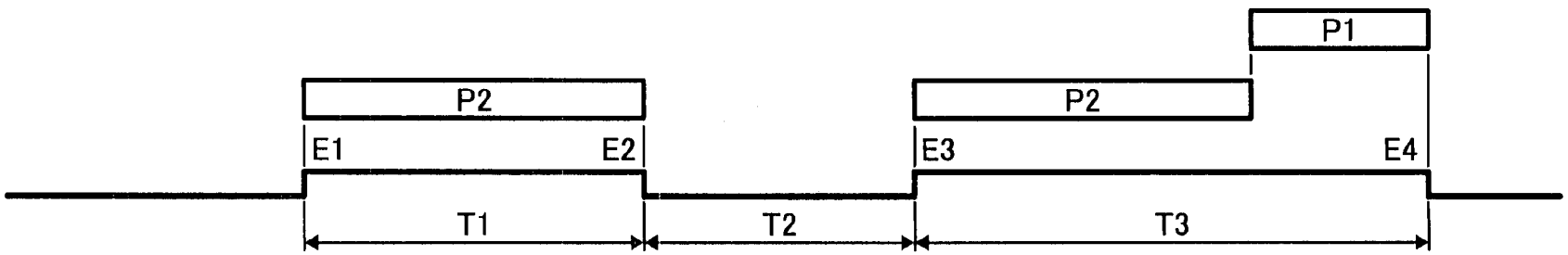
FIG. 25 illustrates (according to an example embodiment of the present invention) a sixteenth pattern of the detection patches.

Referring to FIG. 25, a sixteenth pattern of the detection patches P1 and P2 is illustrated, and detection conditions thereof are as follows.

E=4 & T1=P2 & T2=P2D & T3=P1+P2, where the edge detection number is 4 of E1 to E4, the count value T1 is equivalent to the length of the second detection patch P2, the count value T2 is equivalent to the patch interval of the second detection patches P2*s*, and the count value T3 is equivalent to a sum of the lengths of the first and second detection patches P1 and P2.

Figure 26:
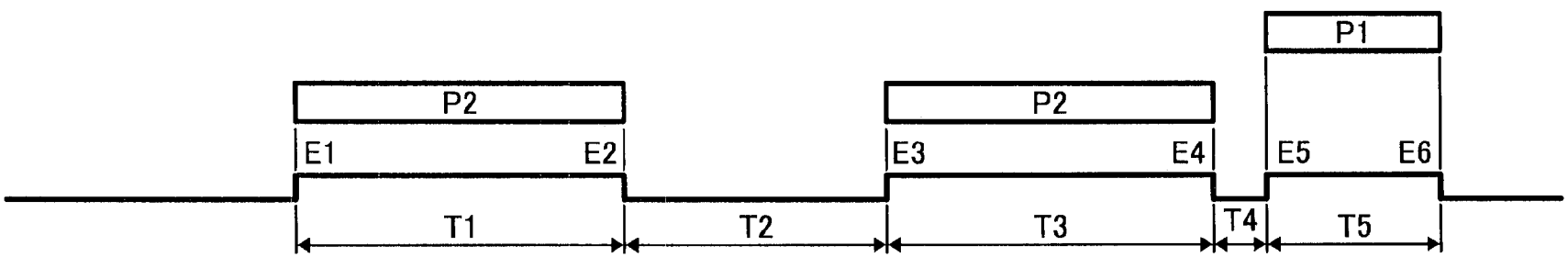
FIG. 26 illustrates (according to an example embodiment of the present invention) a seventeenth pattern of the detection patches.

Referring to FIG. 26, a seventeenth pattern of the detection patches P1 and P2 is illustrated, and detection conditions thereof are as follows.

E=6 & T1=P2 & T2=P2D & T3=P2 & T5=P1, where the edge detection number is 6 of E1 to E6, the count value T1 is equivalent to the length of the second detection patch P2, the count value T2 is equivalent to the patch interval of the second detection patches P2*s*, the count value T3 is equivalent to the length of the second detection patch P2, and the count value T5 is equivalent to the length of the first detection patch P1.

According to the above 17 different patterns with respective detection conditions, the position information of the patches is accurately identified so that the misregistration amount is accurately calculated and the transfer position is corrected. The misregistration amount is accurately calculated from an edge position of a misregistered patch and the count value, a starting point of which is the edge position by using the above formula 1, for example. This calculation is executed by invoking the edge detection number and the count values T1, T2, and T3 stored in the storage unit 26 by the CPU 27, and by computing from the sampling frequency and the count value counted from the edge which is a starting point of each of the count values T1, T2, and T3. When the misregistration amount is calculated, the CPU 27 instructs a correction of an on-time timing of the laser diode LD 30 with respect to the laser diode controller 29. Thereby, the misregistration is corrected by the correction of the LD on-time timing by the laser diode controller 29.

Similarly, the position information of the position detection patch is accurately identified when at least one patch is formed a plurality of times in the traveling direction of the transfer belt 51, a length of the patch which is formed the plurality of times is smaller than that of another detection patch, and an interval of the detection patch which is formed the plurality of times is greater than that of another detection patch. When the position detector 20 is disposed for each color in this example embodiment, for example, four position detectors 20 are disposed, and the image detection patches are formed, the correction for each of the four colors may be performed simultaneously. Thereby, time needed for the correction may be shortened.

Therefore, the length of the position detection patch is counted from the detected edge information, and the misregistration amount of the transfer position is detected from the edge information and the count value so that the misregistration is corrected based on the detected misregistration amount. Thereby, the misregistration of the image is detected with high accuracy and is corrected with a simple configuration.

The above disclosure may be conveniently implemented using a conventional general purpose digital computer programmed according to the teachings of the present specification, as will be apparent to those skilled in the computer art. Appropriate software coding can readily be prepared by skilled programmers based on the teachings of the present disclosure, as will be apparent to those skilled in the software art. The present disclosure may also be implemented by the preparation of application specific integrated circuits or by interconnecting an appropriate network of conventional component circuits, as will be readily apparent to those skilled in the art.

Numerous additional modifications and variations are possible in light of the above teachings. It is therefore to be understood that within the scope of the appended claims, the disclosure of this patent specification may be practiced otherwise than as specifically described herein.

What is claimed is:

1. An image forming apparatus forming a full-color image with a plurality of primary color toners, the apparatus comprising:

a plurality of image forming members each to form a plurality of test patches;

an image transfer member to receive the plurality of test patches from each one of the plurality of image forming members;

a plurality of sensors to detect the plurality of test patches carried on the image transfer member;

a calculator to perform a logical operation relative to detection signals output by the plurality of sensors;

an edge extractor to detect edges and generate edge signals based upon an output signal of the calculator;

a counter to count clock pulses with respect to the edge signals generated by the edge extractor to determine a length of each of the plurality of test patches detected; and a misregistration corrector to calculate time lags among the detection signals based on count values counted by the counter for the plurality of test patches detected and to correct misregistration of the full-color image based on the calculated time lags.

2. The apparatus of claim 1, wherein the misregistration corrector corrects the misregistration of the full-color image by adjusting transfer positions of the plurality of test patches in a sub-scanning direction based on the calculated time lags.

3. The apparatus of claim 1, further comprising:

a memory to store the edge signals generated by the edge extractor and the count values counted by the counter, wherein the counter counts clock pulses with respect to the edge signals stored in the memory, and the misregistration corrector calculates the time lags among the detection signals based on the count values stored in the memory.

4. The apparatus of claim 1, wherein the plurality of sensors are disposed at positions aligned in a main scanning direction.

5. The apparatus of claim 4, wherein the plurality of test patches are formed at a time with one of the plurality of primary colors in a line in the main scanning direction, and the misregistration corrector corrects the misregistration of the full-color image by adjusting mounting positions of the plurality of sensors in a sub-scanning direction based on the calculated time lags.

6. The apparatus of claim 4, wherein the plurality of test patches are formed at equivalent timings with at least two of the plurality of primary colors in a line in the main scanning direction, and the misregistration corrector corrects the misregistration of the full-color image by adjusting mounting angles of corresponding two of the plurality of image forming members in a sub-scanning direction based on the calculated time lags.

7. The apparatus of claim 4, wherein the plurality of test patches are formed with at least two of the plurality of primary colors.

8. The apparatus of claim 4, wherein at least one of the plurality of test patches is formed at least twice to be aligned, each having a length longer than a rest of the plurality of test patches, with a distance therebetween longer than a length of the rest of the plurality of test patches in a sub-scanning direction.

9. The apparatus of claim 4, wherein at least one of the plurality of test patches is formed at least twice to be aligned, each having a length shorter than a rest of the plurality of test patches, with a distance therebetween longer than a length of the rest of the plurality of test patches in a sub-scanning direction.

10. The apparatus of claim 4, wherein the plurality of sensors includes a plurality of sensor sets correspond to the plurality of primary colors.

11. The apparatus of claim 1, wherein the counter counts the clock pulses of a clock signal with respect to the edge signals generated by the edge extractor.

12. The apparatus of claim 1, wherein the misregistration corrector calculates the time lags among the detection signals based on a frequency of the clock signal and the count values counted by the counter for the plurality of test patches detected and corrects misregistration of the full-color image based on the calculated time lags.

13. The apparatus of claim 1, wherein the image transfer member includes a sheet transport belt for transporting a recording sheet onto which a full-color image is transferred therefrom.

14. The apparatus of claim 1, wherein the image transfer member includes an intermediate transfer belt which sequentially receives images into a full-color image through a primary image transfer and transfers the full-color image onto a recording sheet through a secondary image transfer.

15. A method of forming a full-color image with a plurality of primary color toners, the method comprising:

providing an image transfer member and a plurality of sensors;

forming a plurality of test patches on the image transfer member;

detecting the plurality of test patches formed on the image transfer member with the plurality of sensors;

performing a logical operation relative to detection signals output by the plurality of sensors;

detecting edges and generating edge signals based upon an output signal of the logical operation;

counting clock pulses with respect to the edge signals to determine a length of each of the plurality of test patches detected;

calculating time lags among the detection signals based on count values counted by the counting step for the plurality of test patches detected; and correcting misregistration of the full-color image based on the calculated time lags.

16. The method of claim 15, wherein the correcting step corrects the misregistration of the full-color image by adjusting transfer positions of the plurality of test patches in a sub-scanning direction based on the calculated time lags.

17. The method of claim 15, further comprising:

storing the signal edges extracted by an extracting step and the count values counted by the counting step, wherein the counting step counts clock pulses with respect to the signal edges stored in the storing step, and the correcting step calculates the time lags among the detection signals based on the count values stored in the storing step.

18. An image forming apparatus forming a full-color image with a plurality of primary color toners, the apparatus comprising:

a plurality of image forming members each to form a plurality of test patches thereon;

an image transfer member to receive the plurality of test patches from each one of the plurality of image forming members;

detecting means for detecting the plurality of test patches carried on the image transfer member;

performing means for performing an exclusive-OR operation relative to detection signals output by the detecting means;

extracting means for detecting edges and generating edge signals based upon an output signal of the performing means;

counting means for counting clock pulses with respect to the edge signals generated by the extracting means to determine a length of each of the plurality of test patches detected; and a misregistration corrector to calculate time lags among the detection signals based on count values counted by the counting means for the plurality of test patches detected and to correct misregistration of the full-color image based on the calculated time lags.

19. The apparatus of claim 1, wherein the calculator is operable to include an exclusive-OR operation as at least a part of the logical operation.

20. The method of claim 15, wherein the logical operation includes at least an exclusive-OR operation.

* * * * *